US007284971B2

(12) United States Patent
Lee

(10) Patent No.: US 7,284,971 B2
(45) Date of Patent: Oct. 23, 2007

(54) HERMETIC COMPRESSOR

(75) Inventor: Sung Tae Lee, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 534 days.

(21) Appl. No.: 10/863,437

(22) Filed: Jun. 8, 2004

(65) Prior Publication Data

US 2005/0191197 A1 Sep. 1, 2005

(30) Foreign Application Priority Data

Feb. 26, 2004 (KR) ..... 10-2004-0013167

(51) Int. Cl.
*F04B 39/10* (2006.01)
*F04B 53/10* (2006.01)

(52) U.S. Cl. ..... 417/571

(58) Field of Classification Search ..... 417/571
See application file for complete search history.

(56) References Cited

U.S. PATENT DOCUMENTS 5,110,272 A * 5/1992 Peruzzi et al. ..... 417/571
5,178,183 A * 1/1993 Kim ..... 137/527
5,554,016 A * 9/1996 Sasano et al. ..... 417/569
5,558,508 A * 9/1996 Sasano et al. ..... 417/569
5,720,601 A * 2/1998 Tark et al. ..... 417/569
5,769,126 A * 6/1998 Cho ..... 137/856
5,775,887 A * 7/1998 Park et al. ..... 417/569
5,779,459 A * 7/1998 Park et al. ..... 417/571
5,875,819 A * 3/1999 Hwang ..... 137/856
5,887,622 A * 3/1999 Ahn ..... 137/856
5,909,749 A * 6/1999 Lee et al. ..... 137/857
5,934,305 A * 8/1999 Cho ..... 137/15.18
5,993,175 A * 11/1999 Kim et al. ..... 417/417
6,712,591 B2 * 3/2004 Lee ..... 417/569
6,789,575 B2 * 9/2004 Park ..... 137/856
6,827,561 B2 * 12/2004 Seo et al. ..... 417/571
6,932,585 B2 * 8/2005 Na et al. ..... 417/571
2001/0017162 A1 * 8/2001 Seo ..... 137/855
2004/0086406 A1 * 5/2004 Lee ..... 417/569
2005/0095157 A1 * 5/2005 Seo ..... 417/565
2005/0106038 A1 * 5/2005 Yoon et al. ..... 417/312

FOREIGN PATENT DOCUMENTS

JP 2000-087858 3/2000

OTHER PUBLICATIONS

Patent Abstracts of Japan of JP 2000-087858 dated Mar. 28, 2000.

* cited by examiner

*Primary Examiner*—William H. Rodriguez
(74) *Attorney, Agent, or Firm*—Ladas & Parry LLP

(57) ABSTRACT

A hermetic compressor comprising a discharge valve, and a stopper for restricting an opening degree of the discharge valve. The discharge valve includes a body portion configured to cover a discharge port formed at a valve plate, and a first protrusion extending from the body portion. The stopper includes an inclined portion for supporting the body portion, and a second protrusion extending a support portion thereof. In this case, a distance between the first and second protrusions is shorter than a distance between the inclined portion and body portion. With such first and second protrusions, an opening operation of the discharge valve is gradually achieved.

7 Claims, 7 Drawing Sheets

HERMETIC COMPRESSOR

CROSS-REFERENCE TO RELATED APPLICATION

This application claims the benefit of Korean Patent Application No. 2004-13167, filed on Feb. 26, 2004 in the Korean Intellectual Property Office, the disclosure of which is incorporated herein by reference.

BACKGROUND OF THE INVENTION

1. Field of the Invention

The present invention relates to a hermetic compressor, and more particularly to a hermetic compressor capable of reducing the generation of noise by virtue of an improved structure of a valve unit.

2. Description of the Related Art

In general, a hermetic compressor is a device wherein a piston reciprocates inside a cylinder in accordance with rotation of a rotating shaft, thereby serving to compress a refrigerant entering into the cylinder, and to discharge the compressed refrigerant. Such a hermetic compressor basically comprises a compressing unit adapted to compress a refrigerant, and a driving unit adapted to drive the compressing unit.

The compressing unit includes a cylinder defining a compression chamber therein, and a piston reciprocating inside the compression chamber of the cylinder. The compressing unit also includes a cylinder head, which is arranged at one side of the cylinder, and internally defines a suction chamber in communication with the outside, and a discharge chamber. Between the cylinder and cylinder head is interposed a valve unit, which controls the admission and discharge of a refrigerant.

The valve unit includes a valve plate formed with a suction port and discharge port, which provide communication between the cylinder and the respective suction chamber and discharge chamber of the cylinder head, respectively. The valve unit also includes a suction valve for opening or closing the suction port, a discharge valve for opening or closing the discharge port, and a stopper for restricting a maximum opening degree of the discharge valve.

With such a configuration, when the pressure of a refrigerant inside the cylinder is raised beyond the interior pressure of the discharge chamber defined in the cylinder head due to a compression operation of the piston, the discharge valve is opened, thereby allowing the refrigerant in the cylinder to be discharged into the discharge chamber of the cylinder head. Thereafter, when the pressure of the refrigerant inside the cylinder is lowered below the interior pressure of the discharge chamber, the discharge valve is elastically restored, thereby serving to close the discharge port.

Such a conventional hermetic compressor, however, has a problem in that, when discharging the refrigerant, the discharge valve is abruptly opened due to the pressure of the refrigerant, thereby generating vibration and noise as it collides with the stopper. When the discharge valve closes the discharge port, further, the discharge valve collides with the valve plate due to an elastic restoration force thereof, resulting in generation of excessive noise.

SUMMARY OF THE INVENTION

The present invention has been made in view of the above mentioned problem, and an object of the invention is to provide a hermetic compressor which achieves an improvement in the structure of a discharge valve adapted to open or close a discharge port, as well as a stopper, thereby being capable of reducing vibration and noise caused when the discharge valve is opened or closed.

In accordance with one aspect, the present invention provides a hermetic compressor comprising a compression chamber for compressing a refrigerant, and a valve unit including a valve plate formed with a discharge port for use in the discharge of the compressed refrigerant from the compression chamber, a discharge valve for opening or closing the discharge port, and a stopper for restricting an opening degree of the discharge valve, wherein the valve unit further includes: a first protrusion extending outwardly from the discharge valve; and a second protrusion extending from the stopper toward the first protrusion, and adapted to elastically support the first protrusion, whereby the first and second protrusions achieve a gradual opening operation of the discharge valve.

The discharge valve may include a fixing portion to be fixed to the valve plate, and a body portion extending from the fixing portion and configured to cover the discharge port, and the first protrusion may extend outwardly from the body portion.

The stopper may include a support portion for supporting the fixing portion, and an inclined portion extending from one end of the support portion in a direction away from the discharge port so as to support the body portion of the discharge valve, and the second protrusion may extend from the one end of the support portion so that a distance between the first protrusion and second protrusion is shorter than a distance between the inclined portion of the stopper and the body portion of the discharge valve.

The second protrusion may be provided, at a middle portion thereof with a curved portion to increase an elasticity.

The valve unit may further include a retainer for fixing the discharge valve and stopper to the valve plate, and the stopper may further include a pair of elastic dampers formed at both sides of the other end of the support portion, each elastic damper being supported at one side thereof by the retainer, and being adapted at the other side thereof to compress the fixing portion of the discharge valve.

The elastic dampers may be inclined toward the fixing portion, and are bent so as to extend in parallel to the valve plate.

The first protrusion may have a bent portion formed at a distal end thereof, the bent portion being inclined toward the valve plate, and adapted to elastically support the valve plate when the discharge valve is closed.

The valve plate may include a valve seat formed around the discharge port so as to protrude toward the discharge valve, and the bent portion may be configured so that a distance between a bottom thereof to be in contact with the valve plate and the body portion of the discharge valve is longer than a protruding length of the valve seat, thereby allowing the bent portion to come into contact with the valve plate prior to the body portion when the discharge valve is closed.

BRIEF DESCRIPTION OF THE DRAWINGS

The above objects, and other features and advantages of the present invention will become more apparent after reading the following detailed description when taken in conjunction with the drawings, in which.

DETAILED DESCRIPTION OF THE PREFERRED EMBODIMENTS

Preferred embodiments of the present invention will now be described in detail with reference to the annexed drawings.

Figure 1:
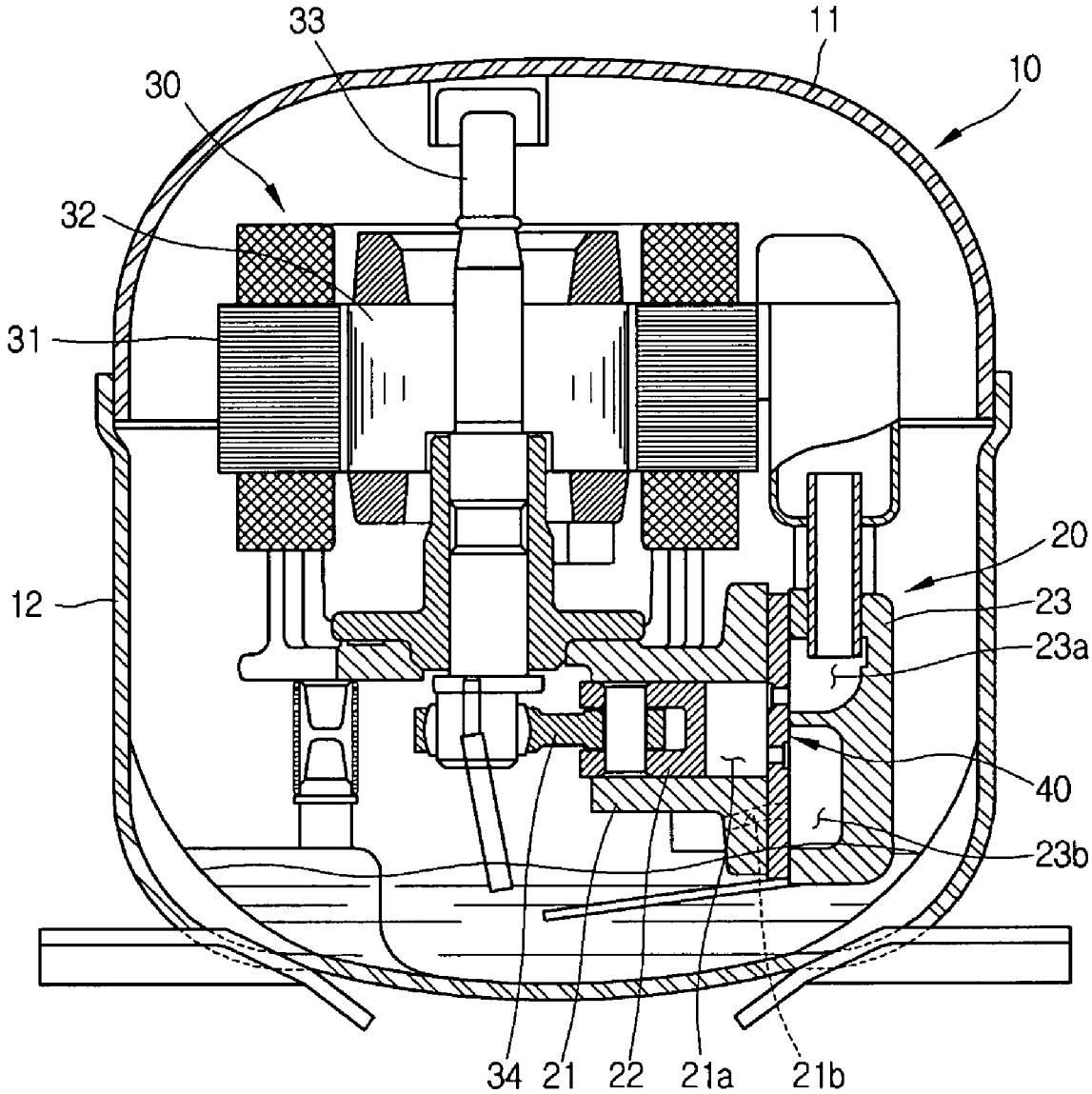
FIG. 1 is a side sectional view illustrating the general structure of a hermetic compressor in accordance with the present invention.

FIG. 1 is a side sectional view illustrating the general structure of a hermetic compressor in accordance with the present invention.

Referring to FIG. 1, the hermetic compressor in accordance with the present invention comprises a hermetic casing 10 which includes upper and lower casings 11 and 12 coupled with each other so as to internally define a hermetic interior space, a compressing unit 20 installed in the casing 10 and adapted to compress a refrigerant, and a driving unit 30 adapted to generate power required to drive the compressing unit 20.

The compressing unit 20 includes a cylinder block 21, which defines therein a compression chamber 21*a*, and a piston 22 reciprocatingly installed inside the compression chamber 21*a* for the suction, compression and discharge of a refrigerant. The compressing unit 20 also includes a cylinder head 23, which is arranged at one side of the cylinder block 21 to face each other and defines therein a suction chamber 23*a* and a discharge chamber 23*b*. Between the cylinder block 21 and cylinder head 23 is interposed a valve unit 40 adapted to control the flow of the refrigerant.

The driving unit 30 serves to drive the piston 22 for achieving a compression operation of the refrigerant in the compressing unit 20. Such a driving unit 30 includes a stator 31 fixedly mounted inside the hermetic casing 10, and a rotor 32 loosely fitted inside the stator 31, and adapted to interact with the stator 31 in an electromagnetic manner. The rotor 32 is coupled, at a central portion thereof, to a rotating shaft 33, which rotates along with the rotor 32, and by means of a connecting rod 34 connected to a lower end of the rotating shaft 33, the piston 22 performs linear movement.

Figure 2:
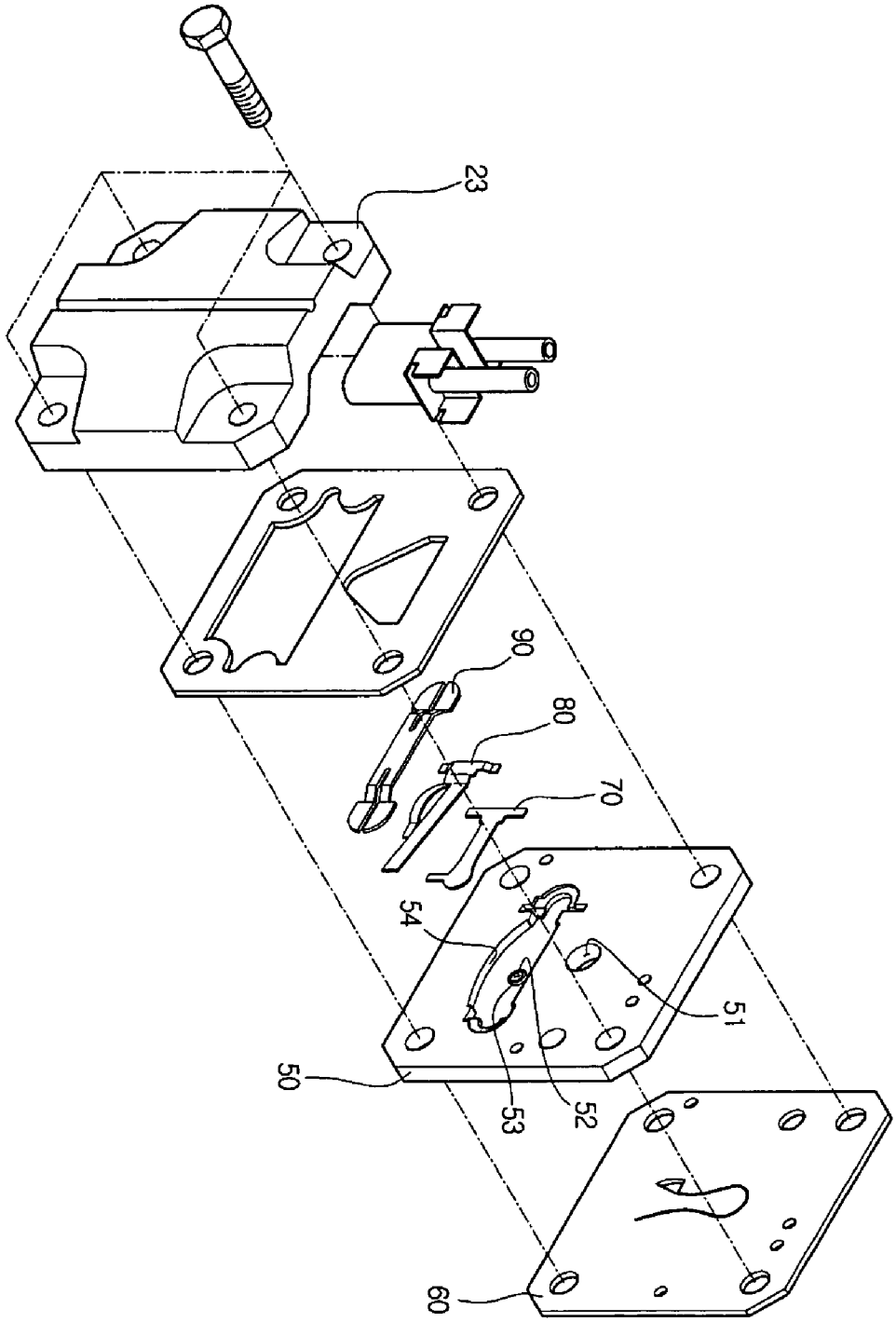
FIG. 2 is an exploded perspective view illustrating a valve unit provided in the hermetic compressor in accordance with the present invention.

Referring to FIG. 2, the valve unit 40 includes a valve plate 50 formed with a suction port 51 and discharge port 52, which enable communication between the compression chamber 21*a* of the cylinder block 21 and the respective suction chamber 23*a* and discharge chamber 23*b* of the cylinder head 23, respectively. The valve unit 40 also includes a suction valve 60 arranged at one side of the valve plate 50 facing the cylinder block 21, and adapted to open or close the suction port 51, and a discharge valve 70 arranged at the other side of the valve plate 50 facing the cylinder head 23, and adapted to open or close the discharge port 52.

The valve plate 50 is further formed with a valve seating recess 54 having a shape corresponding to that of the discharge valve 70 for allowing the seating of the discharge valve 70 therein. The valve seating recess 54 is internally formed with the discharge port 52, and around the discharge port 52 is formed a valve seat 53. The valve seat 53 protrudes toward the discharge valve 70, thereby serving to minimize a contact area between the discharge valve 70 and the valve plate 50.

The valve unit 40 also includes a stopper 80 for restricting an opening degree of the discharge valve 70, and a retainer 90 for fixing the discharge valve 70 and stopper 80 to the valve plate 50, which are successively coupled to one side of the discharge valve 70.

Figure 3:
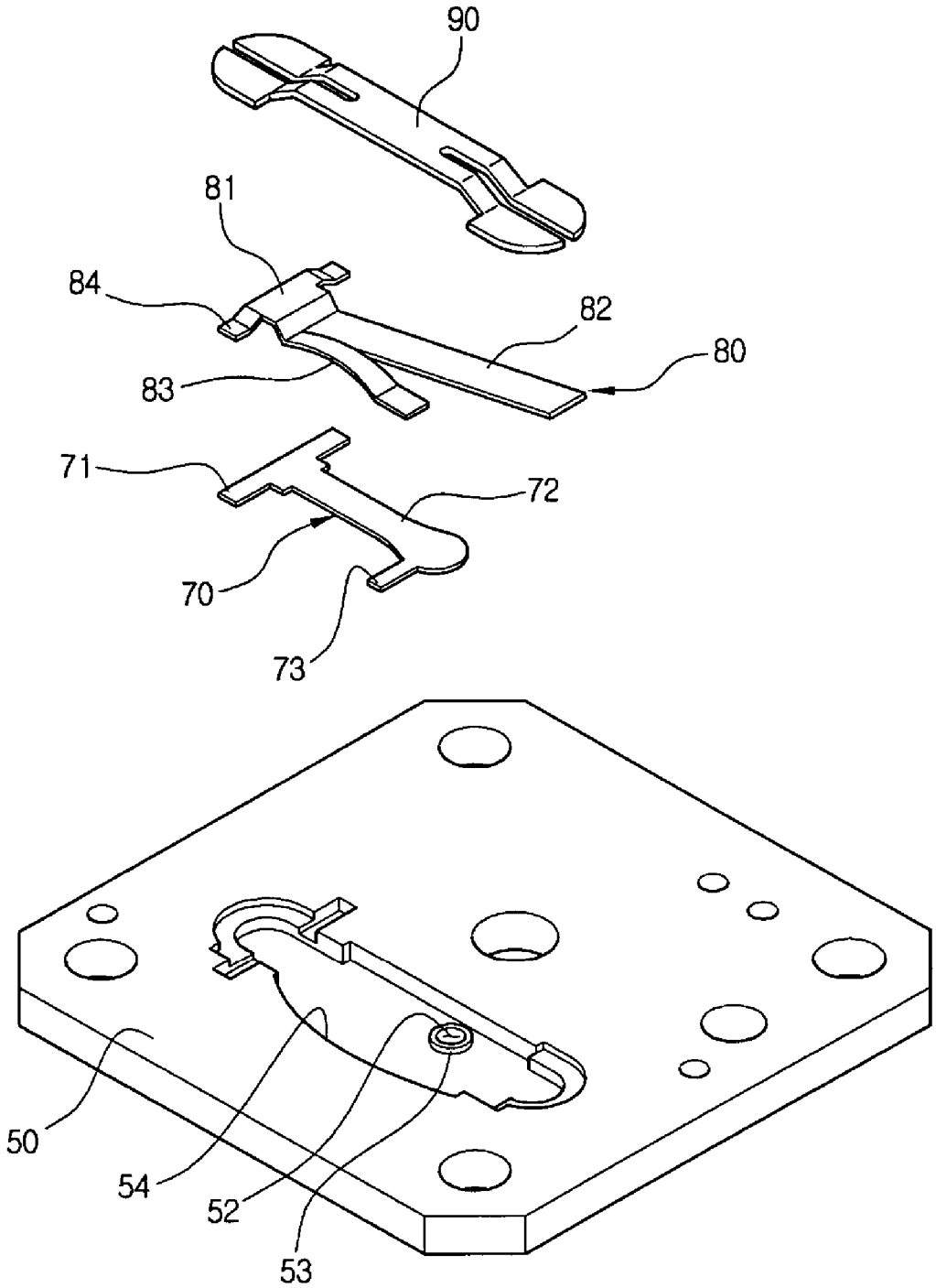
FIG. 3 is an exploded perspective view illustrating critical components of the valve unit provided in the hermetic compressor in accordance with the present invention, shown at an enlarged-scale compared to FIG. 2.

Referring to FIG. 3, illustrating critical components of the valve unit 40, first, the discharge valve 70 takes the form of a metallic thin plate, and includes a fixing portion 71 to be fitted in the valve seating recess 54, and a body portion 72 extending from the fixing portion 71 toward the discharge port 52. In this case, a distal end of the body portion 72 to be positioned above the discharge port 52 forms a free end, and preferably has a circular shape sufficient to cover the discharge port 52. The discharge valve 70 also includes a first protrusion 73 extending outwardly from the circular free end of the body portion 72 in parallel to the valve plate 50. Such a first protrusion 73 is elastically supported by a second protrusion 83 as will be described hereinafter.

The stopper 80 includes a support portion 81 for supporting the fixing portion 71 of the discharge valve 70, an inclined portion 82 extending from one end of the support portion 81 toward the discharge port 52, and the second protrusion 83.

The inclined portion 82 of the stopper 80 is inclined so as to extend in a direction away from the discharge port 52, thereby serving to support the body portion 72 of the discharge valve 70 when the discharge valve 70 is opened. The second protrusion 83 serves to elastically support the first protrusion 73 when the discharge valve 70 is opened, and in order to increase an elasticity thereof, the second protrusion 83 is provided, at the middle thereof with a curved portion. In this case, a distal end of the second protrusion 83 is spaced apart form the first protrusion 73 by a distance shorter than a distance between the inclined portion 82 and body portion 72. By means of both the first and second protrusions 73 and 83, the opening operation of the discharge valve 70 is gradually achieved.

The stopper 80 also includes a pair of elastic dampers 84 formed at both sides the other end of the support portion 81. Each elastic damper 84 is configured so that, first, it is inclined toward the fixing portion 71, and then is bent so as to extend in parallel to the valve plate 50. The elastic damper 84 is supported at one side thereof by the retainer 90, and is adapted at the other side thereof to compress the fixing portion 71, thereby serving to absorb shock caused between the discharge valve 70 and stopper 80 when the discharge valve 70 is opened or closed.

Now, the operation and effects of the hermetic compressor in accordance with the present invention will be explained.

When electric power is applied to the driving unit 30, the rotating shaft 33 rotates along with the rotor 32, and then, by virtue of such rotation of the rotating shaft 33, the piston 22 reciprocates inside the compression chamber 21*a*, thereby performing the suction of a refrigerant from the suction chamber 23*a* of the cylinder 23 and the compression of the sucked refrigerant.

The compressed refrigerant acts to open the discharge valve 70, thereby being discharged into the discharge chamber 23*b* defined in the cylinder head 23 through the discharge port 52 of the valve plate 50.

Figure 4:
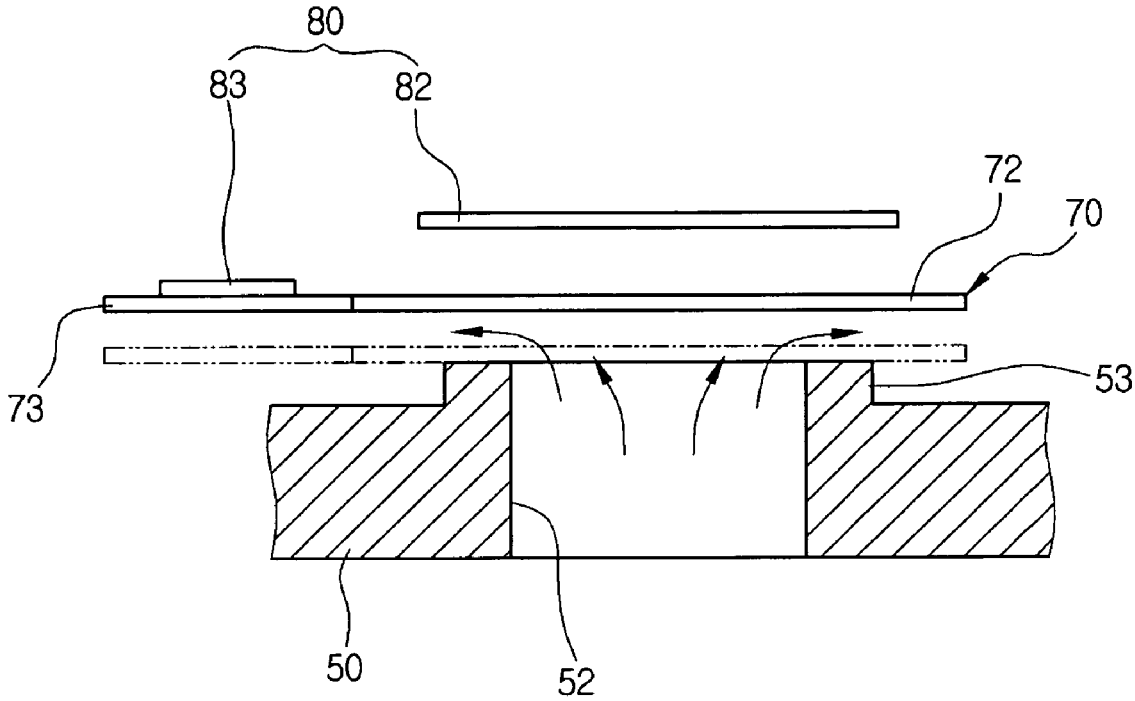
FIG. 4 is a schematic sectional view illustrating a restrictively opened state of a discharge valve provided in the hermetic compressor in accordance with the present invention.
Figure 5:
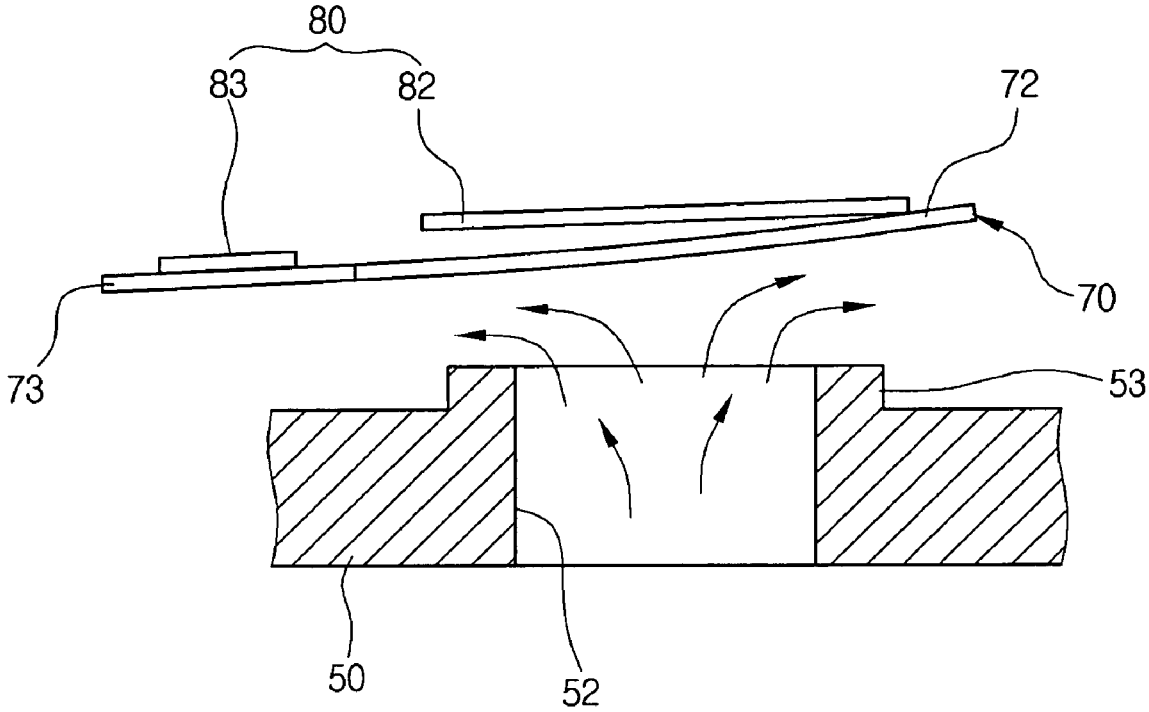
FIG. 5 is a schematic sectional view illustrating a completely opened state of the discharge valve provided in the hermetic compressor in accordance with the present invention.

When opening the discharge valve 70, as shown in FIG. 4, first, it is restrictively opened as the first protrusion 73 thereof is supported by the second protrusion 83 of the stopper 80, and then, as shown in FIG. 5, the discharge valve 70 is completely opened as the body portion 72 thereof is bent toward the inclined portion 82 of the stopper 80 and is supported thereby.

Such a gradual opening operation of the discharge valve 70 prevents its abrupt opening problem, thereby achieving a reduction in shock caused when opening the discharge valve 70. In addition, the elastic dampers 84 formed at the stopper 80 perform shock absorption between the fixing portion 71 of the discharge valve 70 and the retainer 90, thereby reducing vibration and noise caused when opening or closing the discharge valve 70.

Figure 6:
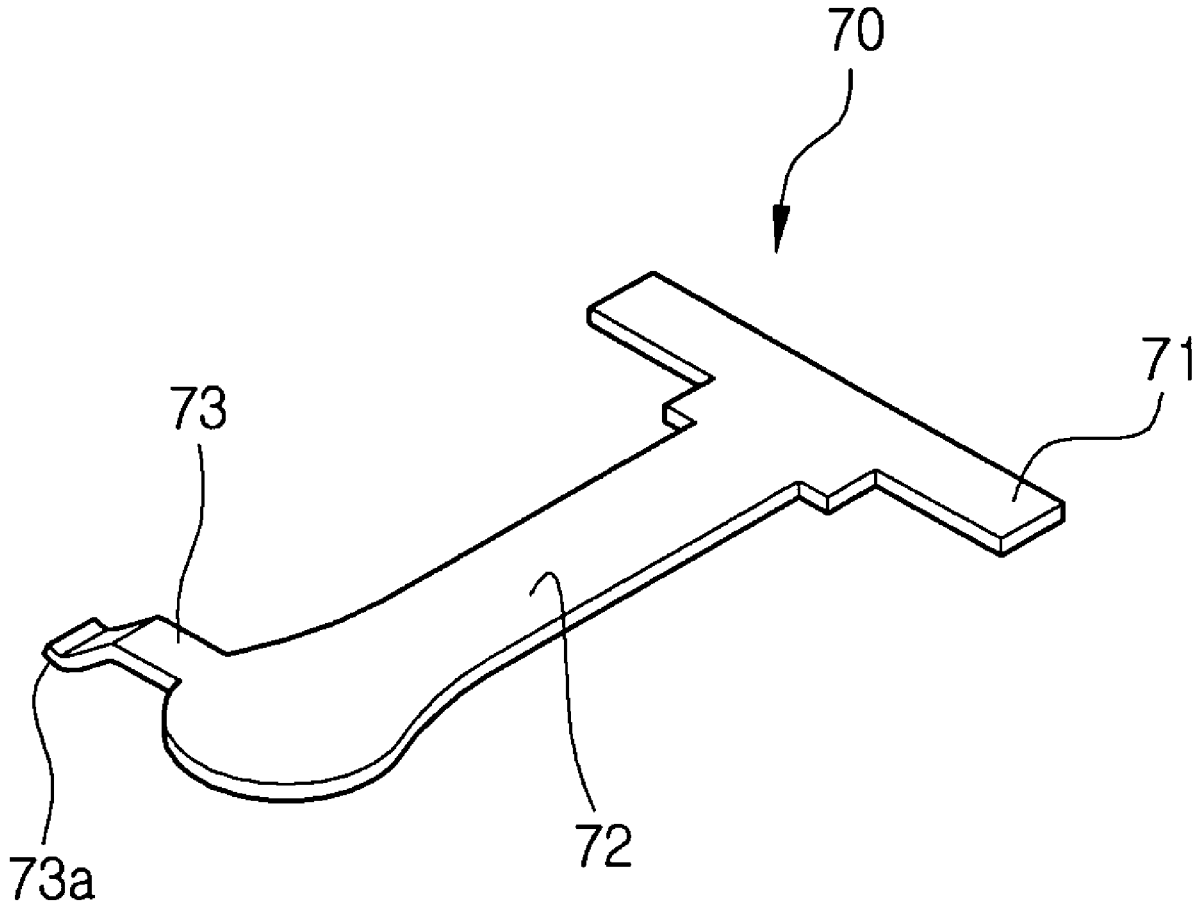
FIG. 6 is a perspective view illustrating another embodiment of the discharge valve provided in the hermetic compressor in accordance with the present invention.
Figure 7:
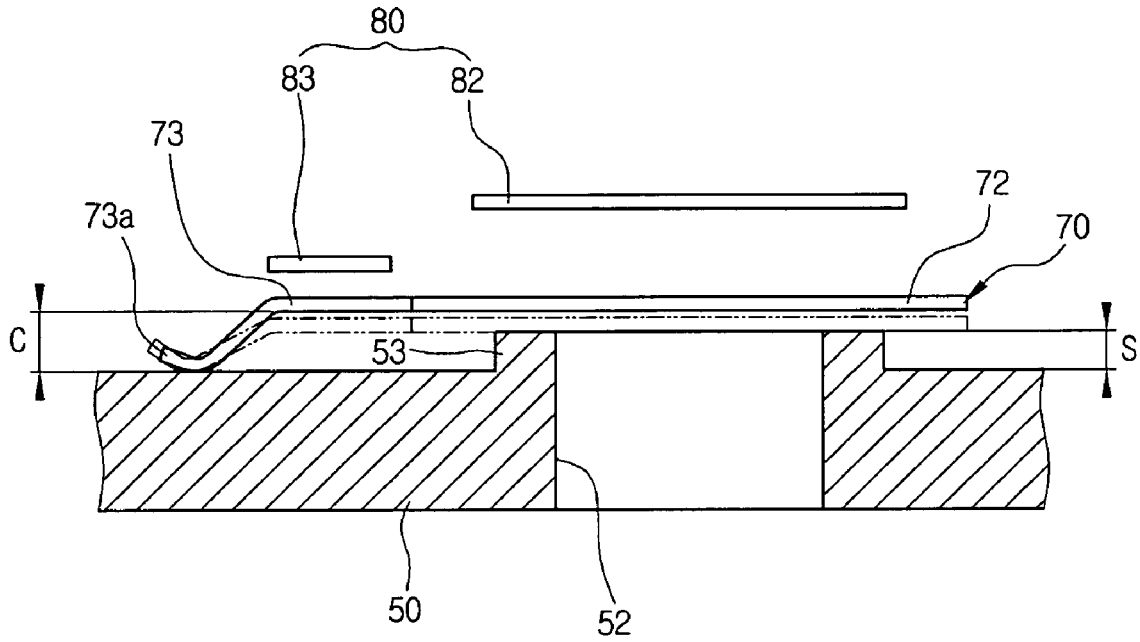
FIG. 7 is a schematic sectional view illustrating the operation of the discharge valve shown in FIG. 6.

As shown in FIGS. 6 and 7, the discharge valve 70, provided in the hermetic compressor in accordance with the present invention, may further include a bent portion 73*a*, which is inclined from a distal end of the first protrusion 73 toward the valve plate 50, and is adapted to elastically support the valve plate 50. A distance (c) between the bottom of the bent portion 73*a* to be in contact with the valve plate 50 and the body portion 72 is longer than a protruding length of the valve seat 83. When the discharge valve 70 is closed, therefore, the bent portion 73*a* comes into contact with the valve plate 50 prior to the body portion 72. As a result, as shown in FIG. 7 with a dotted line, in a state wherein the discharge valve 70 completely closes the discharge port 52 by the elastic restoration force thereof, the bent portion 73*a* preloads the valve plate 50 with a certain elastic force. Such a bent portion 73*a* reduces shock caused between the discharge valve 70 and valve plate 50 when closing the discharge valve 70, thereby being capable of reducing vibration and noise of the discharge valve 70.

As apparent from the above description, in accordance with the hermetic compressor of the present invention, a discharge valve thereof is formed with a first protrusion, and a stopper for restricting an opening degree of the discharge valve is formed with a second protrusion, thereby allowing the discharge valve to be, first, restrictively opened as the first protrusion is supported by the second protrusion, and then be completely opened.

With such a gradual opening operation of the discharge valve, it is possible to prevent abrupt opening of the discharge valve, thereby being capable of reducing shock and consequent vibration and noise caused when opening the discharge valve.

Further, in accordance with the hermetic compressor of the present invention, a pair of elastic dampers are formed at a support portion of the stopper so as to compress a fixing portion of the discharge valve, thereby achieving a reduction in vibration and noise caused between the discharge valve and stopper during the opening and closing operations of the discharge valve.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A hermetic compressor comprising a compression chamber for compressing a refrigerant, a valve unit including a valve plate formed with a discharge port for use in the discharge of the compressed refrigerant from the compression chamber, a discharge valve for opening or closing the discharge port, and a stopper for restricting an opening degree of the discharge valve, wherein the valve unit further includes:

a first protrusion extending outwardly from the discharge valve; and a second protrusion extending from the stopper toward the first protrusion, and elastically supporting the first protrusion, whereby the first and second protrusions achieve a gradual opening operation of the discharge valve, and wherein the discharge valve includes:

a fixing portion to be fixed to the valve plate; and a body portion extending from the fixing portion and configured to cover the discharge port; and the first protrusion extends outwardly from the body portion.

2. The compressor according to claim 1, wherein: the stopper includes a support portion for supporting the fixing portion, and an inclined portion extending from one end of the support portion in a direction away from the discharge port so as to support the body portion of the discharge valve; and the second protrusion extends from the one end of the support portion so that a distance between the first protrusion and second protrusion is shorter than a distance between the inclined portion of the stopper and the body portion of the discharge valve.

3. The compressor according to claim 2, wherein the second protrusion is provided, at a middle portion thereof with a curved portion to increase an elasticity.

4. The compressor according to claim 2, wherein: the valve unit further includes a retainer for fixing the discharge valve and stopper to the valve plate; and the stopper further includes a pair of elastic dampers formed at both sides of the other end of the support portion, each elastic damper being supported at one side thereof by the retainer, and being adapted at the other side thereof to compress the fixing portion of the discharge valve.

5. The compressor according to claim 4, wherein the elastic dampers are inclined toward the fixing portion, and are bent so as to extend in parallel to the valve plate.

6. The compressor according to claim 1, wherein the first protrusion has a bent portion formed at a distal end thereof, the bent portion being inclined toward the valve plate, and adapted to elastically support the valve plate when the discharge valve is closed.

7. The compressor according to claim 6, wherein:

the valve plate includes a valve seat formed around the discharge port so as to protrude toward the discharge valve; and the bent portion is configured so that a distance between a bottom thereof to be in contact with the valve plate and the body portion of the discharge valve is longer than a protruding length of the valve seat, thereby allowing the bent portion to come into contact with the valve plate prior to the body portion when the discharge valve is closed.

* * * * *